US008925836B2

(12) United States Patent
Dettlaff et al.

(10) Patent No.: US 8,925,836 B2
(45) Date of Patent: Jan. 6, 2015

(54) GRAVITY CUP FOR A PAINT SPRAYER

(75) Inventors: Peter Dettlaff, Remseck (DE); Klaus Leipold, Dettenhausen (DE)

(73) Assignee: SATA GmbH & Co. KG, Kornwestheim (DE)

( * ) Notice: Subject to any disclaimer, the term of this patent is extended or adjusted under 35 U.S.C. 154(b) by 898 days.

(21) Appl. No.: 13/121,531

(22) PCT Filed: Sep. 29, 2009

(86) PCT No.: PCT/EP2009/006992
§ 371 (c)(1),
(2), (4) Date: Mar. 29, 2011

(87) PCT Pub. No.: WO2010/049043
PCT Pub. Date: May 6, 2010

(65) Prior Publication Data

US 2011/0174901 A1 Jul. 21, 2011

(30) Foreign Application Priority Data

Oct. 29, 2008 (DE) ..... 20 2008 014 389 U

(51) Int. Cl.

| | |
|---|---|
| ***B05B 7/24*** | (2006.01) |
| ***B05B 9/01*** | (2006.01) |
| ***B05B 9/03*** | (2006.01) |
| ***B65D 41/04*** | (2006.01) |
| ***B65D 39/08*** | (2006.01) |

(52) U.S. Cl.
CPC ..... *B05B 7/2408* (2013.01); *B05B 7/2478* (2013.01)
USPC ..... 239/302; 239/600; 220/296; 215/357

(58) Field of Classification Search
CPC ..... B05B 7/24; B05B 7/2405; B05B 7/2408; B05B 7/2478; B05B 7/2481; B05B 9/01; B05B 9/03; B65D 41/04; B65D 41/06; F16L 37/252
USPC ..... 239/302, 310, 318, 328, 340, 345, 346, 239/376, 377, 379, 600, DIG. 14; 220/293, 220/296, 298; 215/356, 357
See application file for complete search history.

(56) References Cited

U.S. PATENT DOCUMENTS

| | | |
|---|---|---|
| 1,327,260 A | 9/1885 | Hart |
| 1,703,383 A | 2/1929 | Birkenmaier |

(Continued)

FOREIGN PATENT DOCUMENTS

| | | |
|---|---|---|
| AU | 637187 | 5/1993 |
| CA | 521511 | 2/1956 |

(Continued)

OTHER PUBLICATIONS

English translation of International Search report published May 6, 2010 for PCT/EP2009/006992 filed Sep. 29, 2009.

(Continued)

*Primary Examiner* — Darren W Gorman
(74) *Attorney, Agent, or Firm* — Paul D. Bianco; Martin Fleit; Fleit Gibbons Gutman Bongini & Bianco PL

(57) ABSTRACT

The invention relates to a gravity cup for a paint sprayer, having a cup-shaped tank (1) and a cover (2) that can be placed on the tank (1), a multiplex quick-connect thread having at least two external thread turns (18) and internal thread turns (19) engaging with the external thread turns (18) for connecting the tank (1) and the cover (2), characterized in that each external thread turn (18) is formed of a plurality of thread segments (18*a*, 18*b*, 18*j*) disposed along the pitch line of each external thread turn, wherein a gap (18*p*, 18*q* . . . 18*w*) is formed between adjacent thread segments.

19 Claims, 3 Drawing Sheets

(56) References Cited

U.S. PATENT DOCUMENTS 1,703,384 A * 2/1929 Birkenmaier ..... 239/301
1,751,787 A 3/1930 Binks
2,008,381 A 7/1935 Beeg
2,049,700 A 8/1936 Gustafsson
2,051,210 A 8/1936 Gustafsson
2,070,696 A 2/1937 Tracy
2,116,036 A 5/1938 Money
2,204,599 A 6/1940 Jenkins
2,269,057 A 1/1942 Jenkins
D133,223 S 7/1942 Tammen
2,356,865 A 8/1944 Mason
2,416,856 A 3/1947 Thomsen
2,416,923 A 3/1947 Jenkins
2,557,593 A 6/1951 Bjorkman
2,557,606 A 6/1951 Liedberg
2,559,091 A 7/1951 Reasenberg
2,609,961 A 9/1952 Sapien
2,721,004 A 10/1955 Schultz
2,844,267 A 7/1958 Petriccione
2,886,252 A 5/1959 Ehrensperger
3,090,530 A 5/1963 Peeps
3,240,398 A 3/1966 Dalton, Jr.
D208,903 S 10/1967 Zadron et al.
3,381,845 A 5/1968 MacDonald
3,420,106 A 1/1969 Keller et al.
3,435,683 A 4/1969 Keller et al.
3,482,781 A 12/1969 Sharpe
3,524,589 A 8/1970 Pelton, Jr.
3,527,372 A * 9/1970 Manning ..... 220/296
3,622,078 A 11/1971 Gronert
3,645,562 A 2/1972 Fandetti et al.
3,714,967 A 2/1973 Zupan et al.
3,771,539 A 11/1973 De Santis
3,840,143 A * 10/1974 Davis et al. ..... 220/288
3,848,807 A 11/1974 Partida
3,870,223 A 3/1975 Wyant
4,000,915 A 1/1977 Strom
D252,097 S 6/1979 Probst et al.
4,210,263 A 7/1980 Bos
4,273,293 A 6/1981 Hastings
4,411,387 A 10/1983 Stern et al.
D278,543 S 4/1985 Gintz
4,545,536 A 10/1985 Avidon
4,562,965 A 1/1986 Ihmels et al.
4,580,035 A 4/1986 Luscher
4,585,168 A 4/1986 Even et al.
4,614,300 A 9/1986 Falcoff
4,643,330 A * 2/1987 Kennedy ..... 220/288
4,653,661 A 3/1987 Buchner et al.
4,730,753 A 3/1988 Grime
D298,372 S 11/1988 Taylor, Jr.
4,784,184 A 11/1988 Gates
4,806,736 A 2/1989 Schirico
4,832,232 A 5/1989 Broccoli
4,863,781 A 9/1989 Kronzer
4,877,144 A 10/1989 Thanisch
D305,057 S 12/1989 Morgan
4,887,747 A 12/1989 Ostrowsky et al.
4,901,761 A 2/1990 Taylor
4,906,151 A 3/1990 Kubis
4,917,300 A 4/1990 Gloviak et al.
4,946,075 A 8/1990 Lundback
4,964,361 A 10/1990 Aebersold
4,967,600 A 11/1990 Keller
4,969,603 A 11/1990 Norman
4,973,184 A 11/1990 La Salle
D314,421 S 2/1991 Tajima et al.
D314,588 S 2/1991 Denham
4,989,787 A 2/1991 Nikkel et al.
5,020,700 A 6/1991 Krzywdziak et al.
D318,877 S 8/1991 Miranda et al.
5,042,840 A 8/1991 Rieple et al.
D321,597 S 11/1991 Cerny
5,088,648 A 2/1992 Schmon
5,102,045 A 4/1992 Diana
5,119,992 A 6/1992 Grime
5,125,391 A 6/1992 Srivastava et al.
5,135,124 A * 8/1992 Wobser ..... 215/222
5,143,102 A 9/1992 Blaul
5,165,605 A 11/1992 Morita et al.
5,191,797 A 3/1993 Smith
5,228,488 A 7/1993 Fletcher
5,236,128 A 8/1993 Morita et al.
5,289,974 A 3/1994 Grime et al.
5,322,221 A 6/1994 Anderson
5,325,473 A 6/1994 Monroe et al.
5,332,156 A 7/1994 Wheeler
5,333,506 A 8/1994 Smith et al.
5,333,908 A 8/1994 Dorney et al.
5,344,078 A 9/1994 Fritz et al.
5,367,148 A 11/1994 Storch et al.
D353,836 S 12/1994 Carvelli et al.
5,381,962 A 1/1995 Teague
5,435,491 A 7/1995 Sakuma
5,443,642 A 8/1995 Bienduga
5,503,439 A 4/1996 LaJeunesse et al.
5,582,350 A 12/1996 Kosmyna et al.
5,584,899 A 12/1996 Shorts
5,588,562 A 12/1996 Sander et al.
5,592,597 A 1/1997 Kiss
5,609,302 A 3/1997 Smith
5,613,637 A 3/1997 Schmon
D380,301 S 7/1997 Kogutt
5,655,714 A 8/1997 Kieffer et al.
5,662,444 A 9/1997 Schmidt, Jr.
5,695,125 A 12/1997 Kumar
5,704,381 A 1/1998 Millan et al.
5,718,767 A 2/1998 Crum et al.
D391,403 S 3/1998 Josephs
RE35,769 E 4/1998 Grime et al.
5,762,228 A 6/1998 Morgan et al.
5,803,360 A 9/1998 Spitznagel
5,816,501 A 10/1998 LoPresti et al.
5,836,517 A 11/1998 Burns et al.
5,843,515 A 12/1998 Crum et al.
D405,503 S 2/1999 Edo
5,874,680 A 2/1999 Moore
5,884,006 A 3/1999 Frohlich et al.
D409,719 S 5/1999 Kaneko
5,951,190 A 9/1999 Wilson
5,951,296 A 9/1999 Klein
5,954,268 A 9/1999 Joshi et al.
5,979,797 A 11/1999 Castellano
6,006,930 A * 12/1999 Dreyer et al. ..... 215/44
6,010,082 A 1/2000 Peterson
6,017,394 A 1/2000 Crum et al.
6,039,218 A 3/2000 Beck
6,053,429 A * 4/2000 Chang ..... 239/345
6,089,471 A 7/2000 Scholl
6,089,607 A 7/2000 Keeney et al.
6,091,053 A 7/2000 Aonuma
6,092,740 A 7/2000 Liu
6,132,511 A 10/2000 Crum et al.
6,250,567 B1 6/2001 Lewis et al.
D448,451 S 9/2001 Turnbull et al.
6,308,991 B1 10/2001 Royer
D457,599 S 5/2002 Karwoski et al.
D459,432 S 6/2002 Schmon
D459,433 S 6/2002 Schmon
6,431,466 B1 8/2002 Kitajima
6,435,426 B1 8/2002 Copp, Jr.
6,442,276 B1 8/2002 Doljack
6,536,684 B1 3/2003 Wei
6,536,687 B1 3/2003 Navis et al.
6,540,114 B1 4/2003 Popovich et al.
6,543,632 B1 4/2003 McIntyre et al.
6,547,884 B1 4/2003 Crum et al.
6,553,712 B1 4/2003 Majerowski et al.
6,554,009 B1 4/2003 Beijbom et al.
6,585,173 B2 7/2003 Schmon et al.
6,595,441 B2 7/2003 Petrie et al.
6,626,382 B1 9/2003 Liu
6,626,383 B1 9/2003 Campbell
6,647,997 B2 11/2003 Mohn

(56) References Cited

U.S. PATENT DOCUMENTS 6,661,438 B1 12/2003 Shiraishi et al.
D485,685 S 1/2004 Zupkofska et al.
6,675,845 B2 1/2004 Volpenheim et al.
6,692,118 B2 2/2004 Michele et al.
6,712,292 B1 3/2004 Gosis et al.
6,717,584 B2 4/2004 Kulczycka
6,763,964 B1 7/2004 Hurlbut et al.
6,766,763 B2 7/2004 Crum et al.
6,786,345 B2 9/2004 Richards
6,796,514 B1 9/2004 Schwartz
6,801,211 B2 10/2004 Forsline et al.
6,820,824 B1 11/2004 Joseph et al.
6,843,390 B1 1/2005 Bristor
6,845,924 B2 1/2005 Schmon
6,855,173 B2 2/2005 Ehrnsperger et al.
6,863,310 B1 3/2005 Petkovsek
6,863,920 B2 3/2005 Crum et al.
6,874,656 B2 4/2005 Rohr et al.
6,874,664 B1 4/2005 Montgomery
6,877,677 B2 4/2005 Schmon et al.
6,929,019 B2 8/2005 Weinmann et al.
6,945,429 B2 9/2005 Gosis et al.
6,962,432 B2 11/2005 Hofeldt
6,963,331 B1 11/2005 Kobayashi et al.
7,017,838 B2 3/2006 Schmon
7,018,154 B2 3/2006 Schmon
D519,687 S 4/2006 Zahav
7,036,752 B1 5/2006 Hsiang
7,083,119 B2 8/2006 Bouic et al.
7,090,148 B2 8/2006 Petrie et al.
7,097,118 B1 8/2006 Huang
D528,192 S 9/2006 Nicholson
7,106,343 B1 9/2006 Hickman
7,165,732 B2 1/2007 Kosmyna et al.
7,172,139 B2 2/2007 Bouic et al.
7,175,110 B2 2/2007 Vicentini
7,182,213 B2 2/2007 King
D538,050 S 3/2007 Tardif
D538,886 S 3/2007 Huang
7,194,829 B2 3/2007 Boire et al.
D541,053 S 4/2007 Sanders
7,216,813 B2 5/2007 Rogers
D545,943 S 7/2007 Rodgers et al.
7,246,713 B2 7/2007 King
7,249,519 B2 7/2007 Rogers
D548,816 S 8/2007 Schmon
7,255,293 B2 8/2007 Dodd
7,264,131 B2 * 9/2007 Tsutsumi et al. ..... 215/344
D552,213 S 10/2007 Schmon
D552,715 S 10/2007 Schmon
D554,703 S 11/2007 Josephson
D563,505 S 3/2008 Schmon
7,374,111 B2 5/2008 Joseph et al.
D571,463 S 6/2008 Chesnin
7,384,004 B2 6/2008 Rogers
RE40,433 E 7/2008 Schmon
D573,227 S 7/2008 Mirazita et al.
D575,374 S 8/2008 Huang
7,410,106 B2 8/2008 Escoto, Jr. et al.
7,416,140 B2 8/2008 Camilleri et al.
7,422,164 B2 9/2008 Matsumoto
D579,213 S 10/2008 Aipa
D581,107 S 11/2008 Schmon
D581,483 S 11/2008 Bass et al.
D583,013 S 12/2008 Wang
7,458,612 B1 12/2008 Bennett
7,533,678 B2 5/2009 Rosa
7,540,434 B2 6/2009 Gohring et al.
7,542,032 B2 6/2009 Kruse
7,568,638 B2 8/2009 Gehrung
D604,394 S 11/2009 Wang
7,614,571 B2 11/2009 Camilleri et al.
D607,086 S 12/2009 Kosaka
7,624,869 B2 12/2009 Primer
D607,972 S 1/2010 Wang
D608,858 S 1/2010 Baltz et al.
D614,731 S 4/2010 Wang
7,694,896 B2 4/2010 Turnbull et al.
D615,586 S 5/2010 Kudimi
D616,022 S 5/2010 Kudimi
D616,527 S 5/2010 Anderson et al.
7,765,876 B1 8/2010 Chen
D624,668 S 9/2010 Noppe
7,810,744 B2 10/2010 Schmon et al.
7,819,341 B2 10/2010 Schmon et al.
D627,039 S 11/2010 Yu
D627,432 S 11/2010 Escoto et al.
7,823,806 B2 11/2010 Schmon
D629,623 S 12/2010 Lampe
7,913,938 B2 3/2011 Cooper
7,922,107 B2 4/2011 Fox
D637,269 S 5/2011 Wang
D638,121 S 5/2011 Villasana
D639,863 S 6/2011 Langan
D641,067 S 7/2011 Wang
D644,716 S 9/2011 Gehrung
D644,803 S 9/2011 Schmon
D645,094 S 9/2011 Langan
8,042,402 B2 10/2011 Brown et al.
D649,196 S 11/2011 Langan
8,052,071 B2 11/2011 Kruse
D655,347 S 3/2012 Gehrung
8,127,963 B2 3/2012 Gerson et al.
D657,276 S 4/2012 Brose
D661,742 S 6/2012 Clark
D663,960 S 7/2012 Jeronimo
8,240,579 B1 8/2012 Bennett
8,297,536 B2 10/2012 Ruda
D670,085 S 11/2012 Brookman et al.
D671,988 S 12/2012 Leipold
D672,012 S 12/2012 Brose et al.
D674,880 S 1/2013 Schmon
8,352,744 B2 1/2013 Kruse
D681,162 S 4/2013 Kruse
8,444,067 B2 * 5/2013 Schmon et al. ..... 239/302
D689,590 S 9/2013 Brose
D689,593 S 9/2013 Schmon
D690,799 S 10/2013 Maier
D692,530 S 10/2013 Gehrung
8,616,434 B2 12/2013 Wilen
8,626,674 B2 1/2014 Whitehouse
8,757,182 B2 6/2014 Schmon
8,857,732 B2 10/2014 Brose
2001/0004996 A1 6/2001 Schmon
2002/0134861 A1 9/2002 Petrie et al.
2002/0170978 A1 11/2002 Mohn
2003/0025000 A1 2/2003 Schmon et al.
2003/0066218 A1 4/2003 Schweikert
2003/0121476 A1 7/2003 McIntyre et al.
2003/0127046 A1 7/2003 Zehner et al.
2003/0164408 A1 9/2003 Schmon
2003/0177979 A1 9/2003 Crum et al.
2003/0189105 A1 10/2003 Schmon
2003/0209568 A1 11/2003 Douglas et al.
2003/0213857 A1 11/2003 Schmon et al.
2003/0218596 A1 11/2003 Eschler
2003/0230636 A1 12/2003 Rogers
2004/0046051 A1 3/2004 Santa Cruz et al.
2004/0104194 A1 6/2004 Dennison
2004/0129738 A1 7/2004 Stukas
2004/0140373 A1 7/2004 Joseph et al.
2004/0155063 A1 8/2004 Hofeldt
2004/0191406 A1 9/2004 Crum et al.
2004/0217201 A1 11/2004 Ruda
2004/0233223 A1 11/2004 Schkolne et al.
2004/0245208 A1 12/2004 Dennison
2005/0056613 A1 3/2005 King
2005/0082249 A1 4/2005 King
2005/0127201 A1 6/2005 Matsumoto
2005/0145723 A1 7/2005 Blette et al.
2005/0145724 A1 7/2005 Blette et al.
2005/0178854 A1 8/2005 Dodd
2005/0220943 A1 10/2005 Abrams et al.
2005/0248148 A1 11/2005 Schenck et al.

(56) References Cited

U.S. PATENT DOCUMENTS

| | | | |
|---|---|---|---|
| 2005/0252993 | A1 | 11/2005 | Rogers |
| 2005/0252994 | A1 | 11/2005 | Rogers |
| 2005/0268949 | A1 | 12/2005 | Rosa |
| 2006/0000927 | A1 | 1/2006 | Ruda |
| 2006/0007123 | A1 | 1/2006 | Wilson et al. |
| 2006/0048803 | A1 | 3/2006 | Jessup et al. |
| 2006/0081060 | A1 | 4/2006 | Forster |
| 2006/0113409 | A1 | 6/2006 | Camilleri et al. |
| 2006/0171771 | A1 | 8/2006 | Kruse |
| 2006/0192377 | A1 | 8/2006 | Bauer et al. |
| 2006/0196891 | A1 | 9/2006 | Gerson et al. |
| 2007/0029788 | A1 | 2/2007 | Adler |
| 2007/0055883 | A1 | 3/2007 | Kruse |
| 2007/0158349 | A1 | 7/2007 | Schmon et al. |
| 2007/0205305 | A1 | 9/2007 | Vagedes |
| 2007/0221754 | A1 | 9/2007 | Gehrung |
| 2007/0252378 | A1 | 11/2007 | Chambers |
| 2008/0011879 | A1 | 1/2008 | Gerson et al. |
| 2008/0019789 | A1 | 1/2008 | Dunaway et al. |
| 2008/0029619 | A1 | 2/2008 | Gohring et al. |
| 2008/0128533 | A1 | 6/2008 | Gehrung |
| 2008/0179763 | A1 | 7/2008 | Schmon et al. |
| 2008/0251977 | A1 | 10/2008 | Naruse et al. |
| 2008/0264892 | A1 | 10/2008 | Nozawa |
| 2008/0272213 | A1 | 11/2008 | Ting |
| 2009/0014557 | A1 | 1/2009 | Schmon et al. |
| 2009/0026290 | A1 | 1/2009 | Fox |
| 2009/0045623 | A1 | 2/2009 | Schmon |
| 2009/0072050 | A1 | 3/2009 | Ruda |
| 2009/0078789 | A1 | 3/2009 | Kruse |
| 2009/0078790 | A1 | 3/2009 | Camilleri et al. |
| 2009/0143745 | A1 | 6/2009 | Langan et al. |
| 2009/0183516 | A1 | 7/2009 | Appler et al. |
| 2009/0235864 | A1 | 9/2009 | Khoury et al. |
| 2009/0266915 | A1 | 10/2009 | Fedorov |
| 2010/0059533 | A1 | 3/2010 | Unger et al. |
| 2010/0108783 | A1 | 5/2010 | Joseph et al. |
| 2010/0126541 | A1 | 5/2010 | Schmon |
| 2010/0206963 | A1 | 8/2010 | Huang |
| 2011/0125607 | A1 | 5/2011 | Wilen |
| 2011/0168811 | A1 | 7/2011 | Fox et al. |
| 2011/0174901 | A1 | 7/2011 | Dettlaff et al. |
| 2012/0012671 | A1 | 1/2012 | Brose et al. |
| 2012/0097762 | A1 | 4/2012 | Gehrung et al. |
| 2012/0132550 | A1 | 5/2012 | Gerson et al. |
| 2013/0056556 | A1 | 3/2013 | Schmon et al. |
| 2013/0320110 | A1 | 12/2013 | Brose et al. |
| 2014/0048627 | A1 | 2/2014 | Schmon et al. |
| 2014/0059905 | A1 | 3/2014 | Raming |
| 2014/0145003 | A1 | 5/2014 | Schmon et al. |

FOREIGN PATENT DOCUMENTS

| | | | |
|---|---|---|---|
| CA | 2277096 | | 7/1998 |
| CA | 2445183 | | 10/2002 |
| CH | 203 668 | | 6/1939 |
| CH | 542104 | A | 9/1973 |
| CH | 676208 | | 12/1990 |
| CN | 1909971 | | 2/2007 |
| CN | 200954482 | | 10/2007 |
| DE | 460381 | | 5/1928 |
| DE | 3016419 | | 11/1981 |
| DE | 8024829.9 | | 9/1982 |
| DE | 34 02 097 | | 8/1985 |
| DE | 3402945 | A1 | 8/1985 |
| DE | 3517122 | | 5/1986 |
| DE | 3526819 | | 2/1987 |
| DE | 3016419 | C2 | 8/1987 |
| DE | 8702559 | | 10/1987 |
| DE | 3708472 | A1 | 10/1988 |
| DE | 8902223 | | 5/1989 |
| DE | 8905681 | | 11/1989 |
| DE | G 90 01 265 | | 5/1990 |
| DE | 3906219 | | 8/1990 |
| DE | 4302911 | | 8/1993 |
| DE | 69505433 | T2 | 4/1999 |
| DE | 19807973 | | 7/1999 |
| DE | 19832990 | | 1/2000 |
| DE | 20000483 | | 8/2000 |
| DE | 199 41 362 | | 3/2001 |
| DE | 199 45 760 | | 3/2001 |
| DE | 19945760 | | 3/2001 |
| DE | 20114257 | | 2/2002 |
| DE | 102 05 831 | | 8/2003 |
| DE | 03069208 | A1 | 8/2003 |
| DE | 10205831 | | 8/2003 |
| DE | 60200500 1173 | | 8/2004 |
| DE | 10311238 | | 10/2004 |
| DE | 10 2004 027 789 | | 2/2005 |
| DE | 10 2004 027789 | | 2/2005 |
| DE | 29825120 | | 2/2005 |
| DE | 2004027789 | A1 | 2/2005 |
| DE | 20320781 | | 6/2005 |
| DE | 10 2004 014 646 | | 7/2005 |
| DE | 10 2004 003 438 | | 8/2005 |
| DE | 10 2004 007 733 | | 9/2005 |
| DE | 10 2004 021 298 | | 11/2005 |
| DE | 69535077 | T2 | 11/2006 |
| DE | 202007001031 | | 3/2007 |
| DE | 202007001031 | U1 | 3/2007 |
| DE | 60206956 | T2 | 8/2008 |
| EP | 524408 | | 1/1993 |
| EP | 567325 | | 10/1993 |
| EP | 678334 | | 10/1995 |
| EP | 0706832 | | 4/1996 |
| EP | 801002 | | 10/1997 |
| EP | 987060 | | 3/2000 |
| EP | 1081639 | | 3/2001 |
| EP | 1247586 | | 10/2002 |
| EP | 1294490 | | 3/2003 |
| EP | 1366823 | A1 | 12/2003 |
| EP | 1424135 | | 6/2004 |
| EP | 1477232 | A1 | 11/2004 |
| EP | 1479447 | A1 | 11/2004 |
| EP | 1504823 | A1 | 2/2005 |
| EP | 1563913 | | 8/2005 |
| EP | 1574262 | | 9/2005 |
| EP | 1602412 | | 12/2005 |
| EP | 1880771 | A1 | 1/2008 |
| EP | 1902766 | A1 | 3/2008 |
| EP | 1902786 | A1 | 3/2008 |
| EP | 1902876 | | 3/2008 |
| EP | 1930084 | | 6/2008 |
| EP | 1964616 | | 9/2008 |
| EP | 1964616 | A2 | 9/2008 |
| FR | 398333 | | 6/1909 |
| FR | 789762 | | 11/1935 |
| FR | 1410519 | | 9/1964 |
| FR | 2444501 | | 7/1980 |
| FR | 2462200 | A1 | 2/1981 |
| FR | 2 570 140 | | 3/1986 |
| FR | 2 774 928 | | 8/1999 |
| FR | 2927824 | A1 | 8/2009 |
| GB | 190900523 | | 6/1909 |
| GB | 2 132 916 | | 7/1984 |
| GB | 2153260 | | 8/1985 |
| GB | 2411235 | | 8/2005 |
| JP | S5654328 | | 5/1981 |
| JP | H0530749 | | 4/1993 |
| JP | H05172678 | | 7/1993 |
| JP | 674850 | | 3/1994 |
| JP | H06215741 | | 8/1994 |
| JP | 2003042882 | | 2/2002 |
| JP | 2004017044 | | 1/2004 |
| WO | 90/08456 | | 8/1990 |
| WO | 91/16610 | | 10/1991 |
| WO | 92/07346 | | 4/1992 |
| WO | 98/32539 | | 7/1998 |
| WO | 01/12337 | | 2/2001 |
| WO | 0112337 | A1 | 2/2001 |
| WO | 01/99062 | | 12/2001 |
| WO | 02/00355 | | 1/2002 |
| WO | 02/18061 | | 3/2002 |

(56) References Cited

FOREIGN PATENT DOCUMENTS

| | | | | |
|---|---|---|---|---|
| WO | 02/085533 | | 10/2002 | |
| WO | 03/007252 | | 1/2003 | |
| WO | 03/045575 | | 6/2003 | |
| WO | 03/069208 | | 8/2003 | |
| WO | 04/037433 | | 5/2004 | |
| WO | 2004037433 | A1 | 5/2004 | |
| WO | 04/052552 | | 6/2004 | |
| WO | 05/018815 | | 3/2005 | |
| WO | 05/068220 | | 7/2005 | |
| WO | 05/070557 | | 8/2005 | |
| WO | 05/070558 | | 8/2005 | |
| WO | 05/077543 | | 8/2005 | |
| WO | WO 2005070558 | A1 * | 8/2005 | ..... B05B 7/24 |
| WO | 05/115631 | | 12/2005 | |
| WO | 2006065850 | | 6/2006 | |
| WO | 2006065850 | A1 | 6/2006 | |
| WO | 07/128127 | | 11/2007 | |
| WO | 2007133386 | A2 | 11/2007 | |
| WO | 2007/149760 | A2 | 12/2007 | |
| WO | 2009015260 | | 1/2009 | |

OTHER PUBLICATIONS

German Search Report for DE 202008014389.6 completed Jul. 13, 2009.

Canadian Office Action dated Nov. 21, 2012 for related application CA2741703.

Chinese Search Report dated Dec. 5, 2012 for related application CN200980135429.9.

Chinese Office Action dated Dec. 13, 2012 for related application CN200980135429.9.

International Search Report, Written Opinion and International Preliminary Report on Patentability for PCT/EP2004/005381 file May 19, 2004.

International Search Report, Written Opinion and International Preliminary Report on Patentability for PCT/EP2004/011998 filed Oct. 23, 2004.

International Search Report, Written Opinion and International Preliminary Report on Patentability for PCT/EP2005/000435 filed Jan. 18, 2005.

International Search Report, Written Opinion and International Preliminary Report on Patentability for PCT/EP2005/00437 filed Jan. 18, 2005.

International Search Report, Written Opinion and International Preliminary Report on Patentability for PCT/EP2008/063344, filed Oct. 6, 2008.

International Search Report, Written Opinion and International Preliminary Report on Patentability for PCT/EP2010/002392 filed Apr. 20, 2010.

International Search Report, Written Opinion and International Preliminary Report on Patentability for PCT/EP2011/002544 filed May 21, 2011.

International Search Report, Written Opinion and International Preliminary Report on Patentability for PCT/EP2011/066665 filed Sep. 26, 2011.

International Search Report, Written Opinion and International Preliminary Report on Patentability for PCT/EP2010/003399 filed Jun. 7, 2010.

International Search Report, Written Opinion and International Preliminary Report on Patentability for PCT/EP2011/5842 filed Dec. 2, 2010.

International Search Report, Written Opinion and International Preliminary Report on Patentability for PCT/EP2012/01939 filed May 5, 2012.

International Search Report, Written Opinion and International Preliminary Report on Patentability for PCT/EP2009/06992 filed Sep. 29, 2009.

Internet Archive Wayback Machine [online] captured Sep. 25, 2012] retrieved on Sep. 8, 2014] retrieved from the Internet URL:http://web.archive.org/web/20120925210554/http://www.sata.com/index.php?id=sal-check&no cache=1&L=11.

JP Office Action issued agains JP Patent App. 2012-508926 on Feb. 25, 2014 with English translation.

* cited by examiner

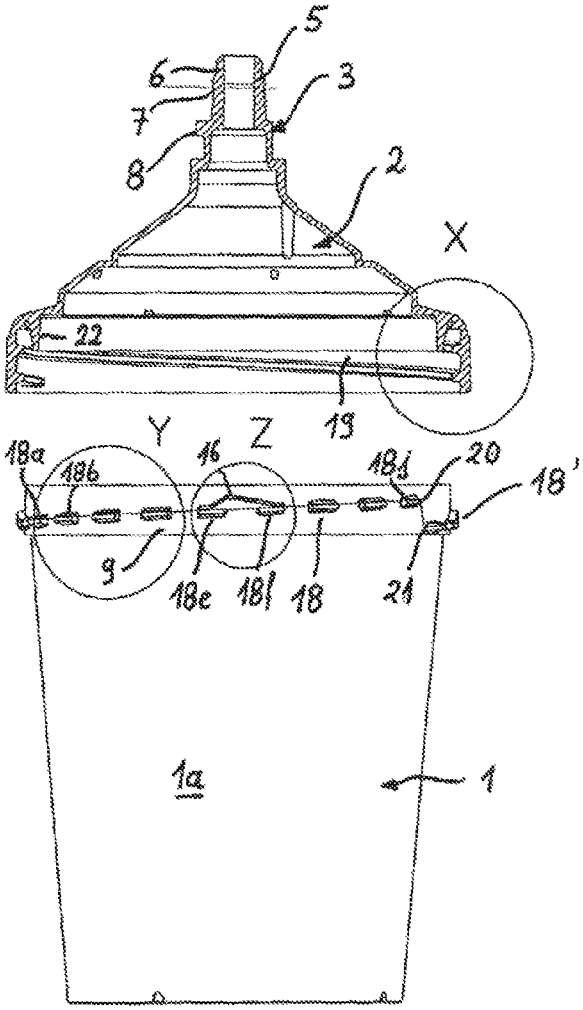
Fig. 2
X Fig. 3
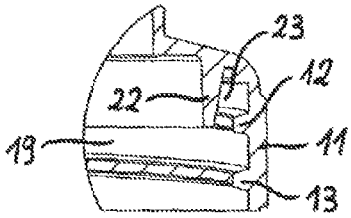
Y Fig. 4
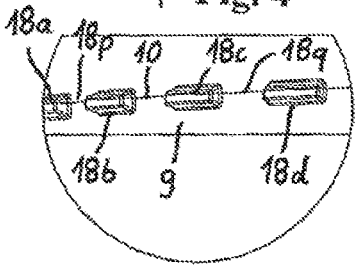
Z Fig. 5
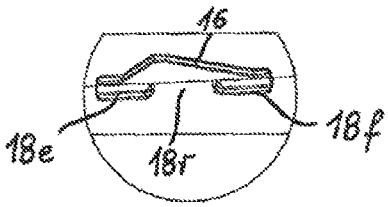

GRAVITY CUP FOR A PAINT SPRAYER

FIELD OF THE INVENTION

The invention concerns a gravity cup for a paint sprayer according to the preamble of claim 1.

BACKGROUND OF THE INVENTION

Traditional gravity cups for paint sprayers usually have a cup-shaped tank, on whose lower side, an opening with a connecting part for the detachable affixing of the tank on the upper side of the paint sprayer is provided. The connecting part usually consists of a connecting piece inserted into the tank bottom, which has an external thread for screwing into a corresponding thread opening on the upper side of the paint sprayer. As a rule, the cup-shaped tank is closed on its upper side by a suitable cover, which is meant to prevent an undesired discharge of the paint.

Gravity cups, which comprise a cup-shaped tank and a cover with a hollow-cylindrical connecting part that can be placed on it, are already known from WO 01/12337 A1, WO2004/037433 A1, EP 1 366 823 A1, and EP 1902786 A1. The connecting part there comprises a connecting piece shaped directly on the tank cover, for a quick connection of the gravity cup to the paint sprayer. With the gravity cup of EP 1902786 A1, furthermore, a quick-connect thread, in the form of a four-turn pitch thread with external thread turns on the upper external circumference of the tank and corresponding internal thread turns on the inside of the cover is provided for the tight connection of the cover with the cup-shaped tank. The four external thread turns on the tank are uniformly distributed over the external circumference of the tank and arranged in such a way that the beginning of the one thread turn is directly over the end of the next thread turn. In this way, the cover can be firmly screwed with the tank by a more or less fourth rotation.

As a result of a nonhomogeneous rigidity of the tank sealing border around the external circumference of the tank, and wall thickness aggregations formed during the injection molding of the tank distributed nonuniformly over the circumference, the tanks known from the state of the art tend to have leaks, especially with a local deformation if the tank is compressed when it is being manually handled in the upper rim area.

SUMMARY OF THE INVENTION

The goal of the invention is to further develop the gravity cups of the types mentioned in the preamble, so that they have an improved tightness between the tank and the cover set on it.

This goal is attained by a gravity cup with the features of claim 1. Appropriate developments and advantageous refinements of the invention comprise the subject of the subclaims.

With the gravity cup in accordance with the invention, which comprises a cup-shaped tank and a cover which can be placed on the tank, a multiplex quick-connect thread with at least two external thread turns and internal thread turns, acting together with the external thread turns, is provided for the connection of the tank and the cover, wherein each external thread turn is formed by a plurality of thread segments located along the slope line of the individual external thread turn. A gap is formed between adjacent thread segments. In this way, wall thickness aggregations that appear in the area of the external thread turns during the injection molding, are largely avoided and the upper rim of the tank has a constant rigidity over the external circumference, which leads to an improved tightness when the cover is screwed on the tank via the quick-connect thread.

The external thread turns are preferably shaped on the upper external circumference of the tank, and the internal thread turns are located on the cover. However, it is also possible to place the external thread turns on the cover and the internal thread turns on the external circumference of the tank. Furthermore, at least one ramp is preferably provided on each external thread turn, which makes possible an improved and especially, a smooth screwing behavior when the cover is screwed on the tank. The guide ramp(s) are appropriately placed on the upper side of each external thread turn, in particular, on the upper side of two adjacent thread segments. In a preferred embodiment, the guide ramps are located between two adjacent thread segments—that is, above the gap—and bridging the two adjacent thread segments.

In a preferred embodiment example, the internal thread turns are located on the inside of a flange on the cover and on the internal circumference of the flange, in the direction of closing of the quick-connect thread, tapering in an axial direction. Upon placing the cover on the tank rim, the guide ramps located on the upper side of each external thread turn act as guide aids and upon screwing the quick-connect thread, the guide ramps mesh into the internal thread turns on the cover and are wedged there as a result of the tapering of the internal thread turn in the closing direction of the quick-connect thread. In this way, a firm seat of the screwed quick-connect thread is guaranteed, which cannot become loosened by itself—for example, because of vibrations during the injection process.

BRIEF DESCRIPTION OF THE DRAWINGS

Other special features and advantages of the invention can be deduced from the following description of a preferred embodiment example with the aid of the drawings. The figures show the following:

FIG. 2, a view of the cup-shaped tank and the cover of the gravity cup of FIG. 1 with a quick-connect thread to screw the cover on the tank;

FIG. 3, a detailed view of area X of FIG. 2;

FIG. 4, a detailed view of area Y of FIG. 2; and

FIG. 5, a detailed view of area Z of FIG. 2;

DETAILED DESCRIPTION OF THE INVENTION

Figure 1:
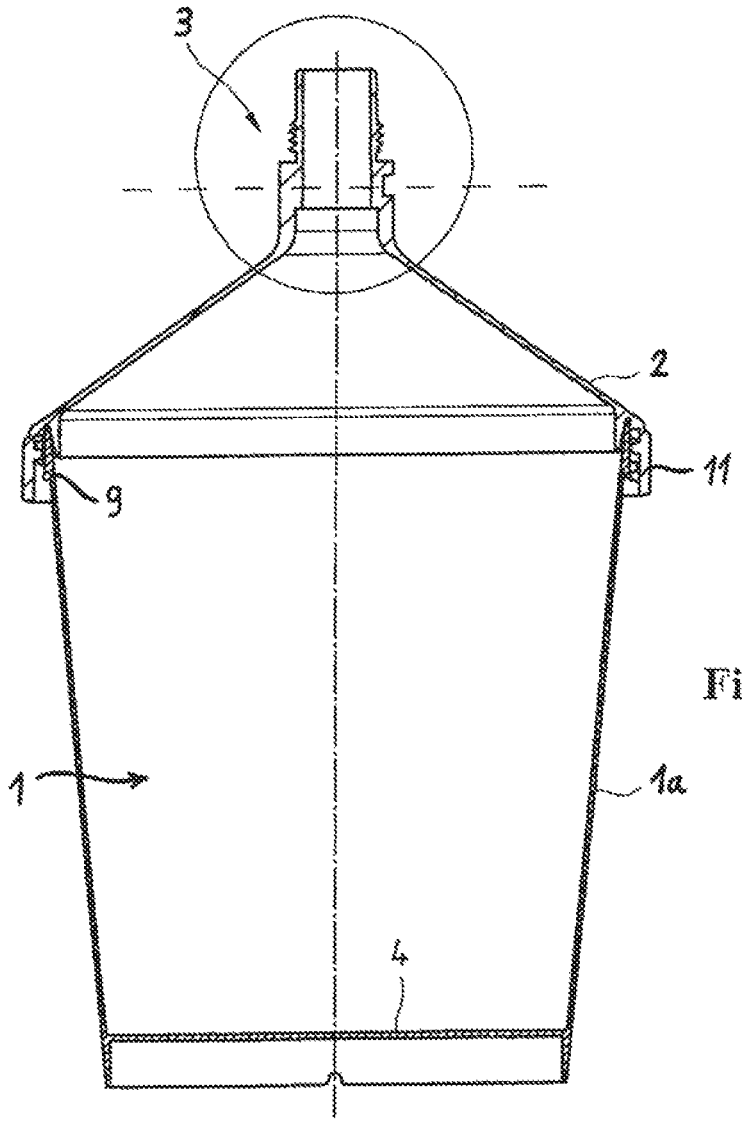
FIG. 1, a gravity cup, in accordance with the invention, with a cup-shaped tank and a cover which is placed on it, in a sectional view.

The gravity cup for a paint sprayer, shown in sectional view in FIG. 1, comprises a cup-shaped tank 1 and a cover 2, placed on it, on which a connecting part 3 is shaped, for the detachable affixing of the gravity cup on a paint sprayer. Both the tank 1 and the cover 2 with the shaped connecting part 3 are appropriately produced as injection moldings made of plastic. FIG. 2 shows the gravity cup with the cover 2 removed from the tank 1, in a side view. In the position shown in FIG. 2, with the removed cover 2, the cup-shaped tank 1 is filled with a liquid, in particular, a paint, to be sprayed by means of a paint sprayer. Subsequently, the cover 2 is placed on the upper rim of the tank and screwed with the tank via a quick-connect thread. Then, the gravity cup can be inserted, with the connecting part 3 shaped on the cover 2, into the connecting opening of a paint sprayer placed on its head. For the spraying, the paint sprayer can then be turned around, so that the gravity cup is on the upper side of the paint sprayer. In order to make possible a venting of the gravity cup, a venting valve, which is not depicted here, is provided, which is appropriately located on the bottom 4 of the tank 1 and is designed in such a way that it can be closed. The venting valve, which can again be closed after use, offers the advantage that the gravity cup can also be used to store paint which has not been completely used up.

The connecting part 3 consists of a tubular connecting piece 5, which is injected on the conical cover or is shaped in some other way and which comprises a front hollow-cylindrical guide area 6, an external thread 7, which follows, for screwing into a conventional internal thread, and a screw wedge element 8, which follows the external thread 7, for a quick connection of the gravity cup with the paint sprayer.

For the tight connection of the tank 1 and the cover 2, a four-turn quick-connect thread with external thread turns 18, 18', shaped on the upper external circumference of the tank 1, and corresponding internal thread turns 19, are provided on the cover 2, as can be seen from FIG. 2. The four external thread turns 18, 18' are located, uniformly distributed over the external circumference, on the upper rim of the tank 1. Each external thread turn 18, 18' is formed by a plurality of thread segments 18*a*, 18*b*, . . . , 18*e*, 18*f*, . . . , 18*j*, arranged along the slope line 10 of the individual external thread turn 18, 18', wherein a gap 18*p*, 18*q*, 18*r*, . . . is formed. Each external thread turn 18, 18' has at least two thread segments 18*a*, 18*b*, and preferably between four and 10 thread segments. In the embodiment example, shown graphically in FIG. 2, 9 thread segments 18*a*, 18*b*, . . . , 18*e*, 18*f*, . . . , 18*j* are provided per external thread turn 18, 18'.

Each external thread turn 18, 18' has a guide ramp 16. The guide ramp 16 is located on the upper border of two adjacent thread segments 18*e*, 18*f* of the external thread turn 18, 18', as shown in FIG. 5. The guide ramp 16 thereby bridges the two adjacent thread segments 18*e*, 18*f*.

Figure 7:
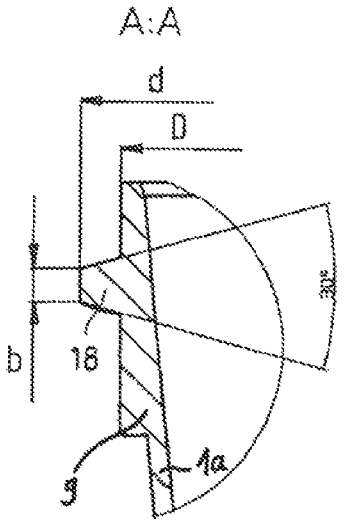
FIG. 7, a sectional view along the line A-A of FIG. 6.
Figure 6:
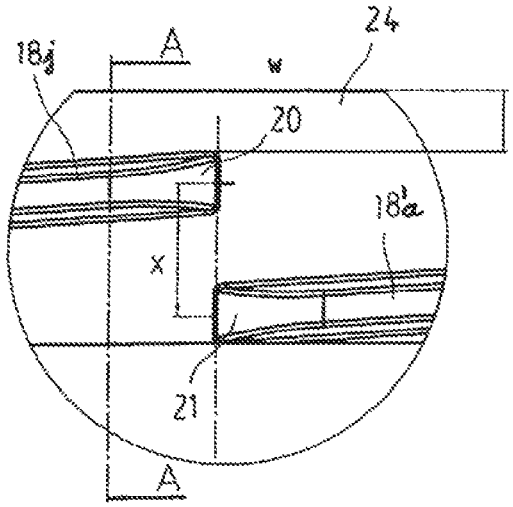
FIG. 6, a detailed view of the transitional area of a thread turn of the quick-connect thread to the next thread turn.

The internal thread turns 19 are located on the inside of a flange 11 on the cover 2 (FIG. 3). Each internal thread turn 19 is limited by a first crosslink 12 and a second crosslink 13. The crosslinks 12, 13 are on the inside surface of the flange 11 and run, at an incline with a slope angle corresponding to the slope angle of the external thread turns 18, 18', on the inside circumference of the flange over a limited angle range. The number of crosslink pairs 12, 13, limiting an internal thread turn, corresponds to the number of the external thread turns 18, 18'. In the graphically depicted embodiment example, four external thread turns 18, 18' and correspondingly, four internal thread turns 19, are provided. In this embodiment example, the crosslinks 12, 13 then run, over approximately 150°, on the inside circumference of flange 11, wherein the beginnings and the ends of the crosslinks 12, 13 are located, staggered by approximately 90°, with respect to one another, and the first crosslink 13 first forms the lower crosslink of the one internal thread turn and then goes over to the upper crosslink 12 of the adjacent internal thread turn. In the connecting direction of the quick-connect thread, the crosslinks 12, 13 run smoothly toward one another, so that the width of each internal thread turn 19 tapers slightly in the axial direction On the upper rim of the tank 1, a rim flange 9, thickened in comparison to the tank wall 1*a*, is provided. The four external thread turns 18, 18' are preferably located on this rim flange 9, in such a way that the end 20 of the one thread turn 18 lies directly above the beginning 21 of the next thread turn, as shown in FIG. 6. The distance between the end 20 of the one thread turn 18 and the beginning 21 of the next thread turn 18' is, for example, 4-6 mm. The quick-connect thread is preferably designed as a pitch thread with a slope of, for example, 20 mm. In this way, the cover 2 can be screwed firmly with the tank 1 by, more or less, one-fourth of a rotation. As can be seen from FIG. 7, the thread in the embodiment shown is also designed as a trapezoidal thread with a flank angle of approximately 30°. The quick-connect thread, however, can also be designed as a round thread, a sharp thread, or with another suitable profile. In the preferred embodiment, the outside diameter of the external thread is between 100 and 110 mm, preferably and approximately 105 mm, and the core diameter D of the external thread is between 90 and 105 mm, preferably and approximately 102 mm. The width b of the thread turns on the outside is between 1.1 and 1.3 mm in this embodiment example.

Upon placing the cover 2 on the tank 1, the lower border of the upper crosslink 12 of the internal thread turns is first on the upper border of the external thread turns 18, 18'. By turning the cover 2, with respect to the tank 1, in the closing direction of the quick-connect thread, the external thread turns 18, 18' mesh into the internal thread turns 19, wherein the guide ramps 16 serve as a guide and prevent tilting. With a further turning of the cover, the guide ramps 16 mesh into the internal thread turns 19 and are clamped there—as a result of the tapering width of the internal thread turns—between the upper crosslink 12 and the lower crosslink 13. The lower border of the two thread segments 18*e*, 18*f*, over which the guide ramp 16 is located, thereby form the counterbearing on the upper border of the lower crosslink 13.

Furthermore, an all-round wedge-shaped sealing crosslink 22, shown in FIG. 5, is shaped on the inside of the cover 2; it limits a wedge-shaped, annular groove 23 for the holding of the upper tank rim 24 between its outside and the inside of the cover. By means of the constricting annular groove 23, wedge-shaped upwards in FIG. 5, the upper tank rim 24 is pressed toward the outside on the inside wall of the cover flange 12 when the cover 2 is screwed on, wherein a tightly closing connection is brought about. The sealing crosslink 22 has a sufficiently great height so as to capture paint still remaining in the cover when the cover is placed and to prevent overflowing into the internal thread.

The invention is not limited to the previously described embodiment example shown in the drawing. Thus, for example, the number of the external thread turns 18, 18' and the internal thread turns 29 can be varied. Furthermore, the number of the thread segments of the external thread turns can be selected differently, wherein at least two thread segments are present per external thread turn. The internal thread turns can also be placed on the upper rim of the tank and the external thread turns can be placed on the cover. Moreover, the internal thread turns can also be made in the form of grooves on the inside surface of the flange 11 or on the upper circumference area of the tank. The connection of the cover on the tank, in accordance with the invention, can, for example, also be used with gravity cups in which the connecting piece for the connection of the gravity cup with the paint sprayer is not located on the cover, but rather on the bottom of the tank. Furthermore, in the embodiment in which the connecting piece is shaped on the cover, an insert (liner), which can be folded together, for holding the paint and affixed on the upper rim of the tank, can be placed in the tank.

The invention claimed is:

1. A gravity cup for a paint sprayer, comprising:

a cup-shaped tank having at least two tank threads forming a first part of a multiplex quick-connect, the tank threads formed as a plurality of separated and aligned thread segments, each tank thread including a guide ramp on an upper side of the thread configured to bridge two thread segments; and a cover having cover threads mateable with the tank threads to form a second part of the multiplex quick-connect.

2. The gravity cup according to claim 1, wherein there are at least two tank thread turns, and each tank thread turn includes at least two thread segments.

3. The gravity cup according to claim 1, wherein there are between four and ten tank thread segments.

4. The gravity cup according to claim 1, wherein the tank thread turns are shaped to extend from an upper external circumference of the tank.

5. The gravity cup according to claim 1, wherein the cover thread turns are arranged within an interior of a flange formed on the cover.

6. The gravity cup according to claim 5, wherein a wedge-shaped sealing crosslink extends circumferentially within an interior of the cover, to form a wedge-shaped annular groove for sealing an upper rim of the tank against the cover.

7. The gravity cup according to claim 1, the cover further including a connecting piece configured for connecting the gravity cup to a paint sprayer.

8. The gravity cup according to claim 7, wherein a quick-alternating connection with a screw wedge element is provided on the connecting piece, which acts together with a counter-element on the paint sprayer for a quick connection of the gravity cup to the paint sprayer.

9. The gravity cup according to claim 1, wherein the quick-connect thread comprises four tank thread turns, which are arranged, uniformly distributed, over an upper external circumference of the tank.

10. The gravity cup according to claim 2, wherein the tank thread turns have a trapezoidal cross-sectional shape.

11. The gravity cup according to claim 1, wherein adjacent cover threads form turns which taper in the direction of closing of the quick-connect along an axial direction with respect to a rotational axis of the cover threads.

12. The gravity cup according to claim 1, wherein a rim flange, thickened in comparison to a side wall of the tank, is provided on an upper rim of the tank.

13. The gravity cup according to claim 11, wherein the thickness of the tank side wall is between 0.2 and 1.5 mm, and the thickness of the upper rim flange is between 0.4 and 2 mm.

14. A gravity cup for a paint sprayer, comprising:

a cup-shaped tank having at least two tank threads forming a first part of a multiplex quick-connect, the tank threads formed as a plurality of separated and aligned thread segments;

a cover having cover threads mateable with the tank threads to form a second part of the multiplex quick-connect;

a plurality of guide ramps each extending from an upper side of a corresponding one of said tank threads and sized and dimensioned to separate the tank thread from which it extends from an adjacent cover thread, when the tank threads and the cover threads are being mated.

15. The gravity cup according to claim 14, wherein each of the plurality of guide ramps bridges two tank thread segments.

16. The gravity cup according to claim 14, wherein adjacent cover threads form turns which taper in the direction of closing of the quick-connect along an axial direction with respect to a rotational axis of the cover threads.

17. A gravity cup for a paint sprayer, comprising:

a cup-shaped tank having at least two tank threads forming a first part of a multiplex quick-connect, the tank threads formed as a plurality of separated and aligned thread segments;

a cover having at least two cover threads mateable with the tank threads to form a second part of the multiplex quick-connect; and at least one of the at least two tank threads and the at least two cover threads include two threads which taper towards each other in the direction of closing of the quick-connect.

18. The gravity cup of claim 17, further including a plurality of guide ramps each extending from an upper side of a corresponding one of said tank threads and sized and dimensioned to separate the tank thread from which it extends from an adjacent cover thread, when the tank threads and the cover threads are being mated.

19. The gravity cup of claim 17, wherein a wedge-shaped sealing crosslink extends circumferentially within an interior of the cover to form a wedge-shaped annular groove for sealing an upper rim of the tank against the cover.

* * * * *